US006499818B2

(12) United States Patent
Brüstle

(10) Patent No.: US 6,499,818 B2
(45) Date of Patent: Dec. 31, 2002

(54) PULL-OUT GUIDANCE ASSEMBLY FOR DRAWERS

(75) Inventor: Klaus Brüstle, Höchst (AT)

(73) Assignee: Julius Blum Gesellschaft m.b.H., Höchst (AT)

( * ) Notice: Subject to any disclaimer, the term of this patent is extended or adjusted under 35 U.S.C. 154(b) by 8 days.

(21) Appl. No.: 09/758,215

(22) Filed: Jan. 12, 2001

(65) Prior Publication Data

US 2001/0008358 A1 Jul. 19, 2001

(30) Foreign Application Priority Data

Jan. 14, 2000 (AT) ..... 50/00
Mar. 10, 2000 (AT) ..... 401/00

(51) Int. Cl.[7] ..... A47B 88/12
(52) U.S. Cl. ..... 312/319.1; 312/331; 312/330.1
(58) Field of Search ..... 312/330.1, 331, 312/333, 334.1, 334.8, 319.1, 334.7, 334.16, 334.44; 384/20, 22

(56) References Cited

U.S. PATENT DOCUMENTS 1,758,550 A * 5/1930 Wolters ..... 312/331
1,902,795 A * 3/1933 Wolters ..... 312/331
4,320,934 A * 3/1982 Rock et al. ..... 312/331
4,494,806 A * 1/1985 Williams et al. ..... 312/330.1 X
4,635,763 A * 1/1987 Omata ..... 312/330.1 X
4,828,344 A * 5/1989 Omata ..... 312/330.1 X
5,207,781 A 5/1993 Röck ..... 312/319.1
5,474,375 A 12/1995 Hollenstein et al. ..... 312/319.1
5,492,400 A * 2/1996 Rock ..... 312/331
5,658,058 A * 8/1997 Bivens et al. ..... 312/331

FOREIGN PATENT DOCUMENTS

DE 29916841 U1 2/2000
GB 2022992 * 12/1979 ..... 312/331
GB 2 245 157 A 1/1992
GB 2 245 158 A 1/1992
JP 5-317133 3/1993

* cited by examiner

*Primary Examiner*—James O. Hansen
(74) *Attorney, Agent, or Firm*—Wenderoth, Lind & Ponack, L.L.P.

(57) ABSTRACT

A pull-out guidance assembly for drawers has one drawer-side pull-out rail and one body-side bearing rail on both sides of the drawer. A fluidic damper is provided as a rotation damper (20). Between the bearing rail (4) and the pull-out rail (6) is displaceably disposed a center rail (5). The pull-out rail (6) is set into a drawer side wall (3) and fixed therein. The fluidic damper, which is mounted on the pull-out rail (6) or the drawer side wall (3), includes a pinion (10), which meshes with a rack section (16) of a slider (8) movable relative to the pull-out rail (6), to the drawer side wall (3) and to the bearing rail (4). A stop (11) disposed on the bearing rail (4) is provided for the slider (8).

13 Claims, 4 Drawing Sheets

1
12
14
16
10
7
3
11
9
2
12
10
7
16
8
2
13
12
10
7
16
8
2
11
3
9

PULL-OUT GUIDANCE ASSEMBLY FOR DRAWERS

BACKGROUND OF THE INVENTION

The invention relates to a pull-out guidance assembly for drawers with one drawer-side pullout rail and one body-side bearing rail on both sides of the drawer. A fluidic damper, provided as a rotation damper, is provided between the bearing rail and the pull-out rail. If appropriate, a center rail is displaceably disposed and the pull-out rail is preferably set into a drawer side wall and fixed in it.

GB 2 245 158 A discloses a pull-out guidance assembly for drawers with a pull-in device and a fluidic damper developed as a rotation damper. The fluidic damper is disposed in a carriage which, in the rearward moving region of the drawer, can be coupled with it.

SUMMARY OF THE INVENTION

The objective of the invention is improving a pull-out guidance assembly of the above described type to the extent that the rotation damper can be disposed in its entirety in the drawer, whereby the rotation damper, together with the drawer, can also be set into the furniture body.

The objective according to the invention is solved by the rotation damper being mounted on the pull-out rail or the drawer side wall and comprising a pinion gear which meshes with a toothed rack section of a slider movable relative to the pull-out rail, to the drawer side wall and to the bearing rail. A body-side stop, disposed preferably on the bearing rail, is provided for the slider.

BRIEF DESCRIPTION OF THE DRAWINGS

In the following, an exemplary embodiment of the invention will be described in conjunction with the Figures of the enclosed drawings, in which.

DETAILED DESCRIPTION OF THE PREFERRED EMBODIMENT

Figure 1:
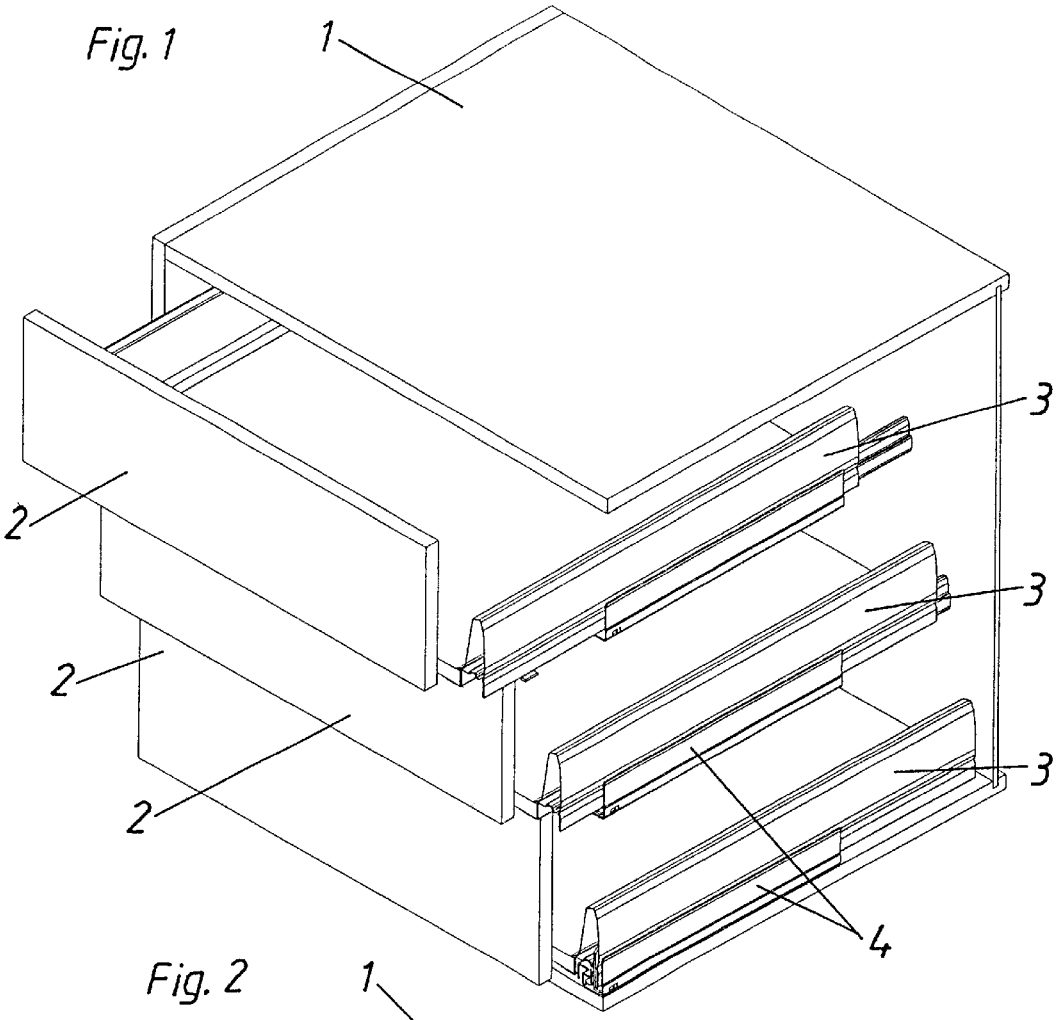
FIG. 1 is a schematic diagram of a furniture body with drawers in different positions with one side wall of the furniture body having been omitted.
Figure 2:
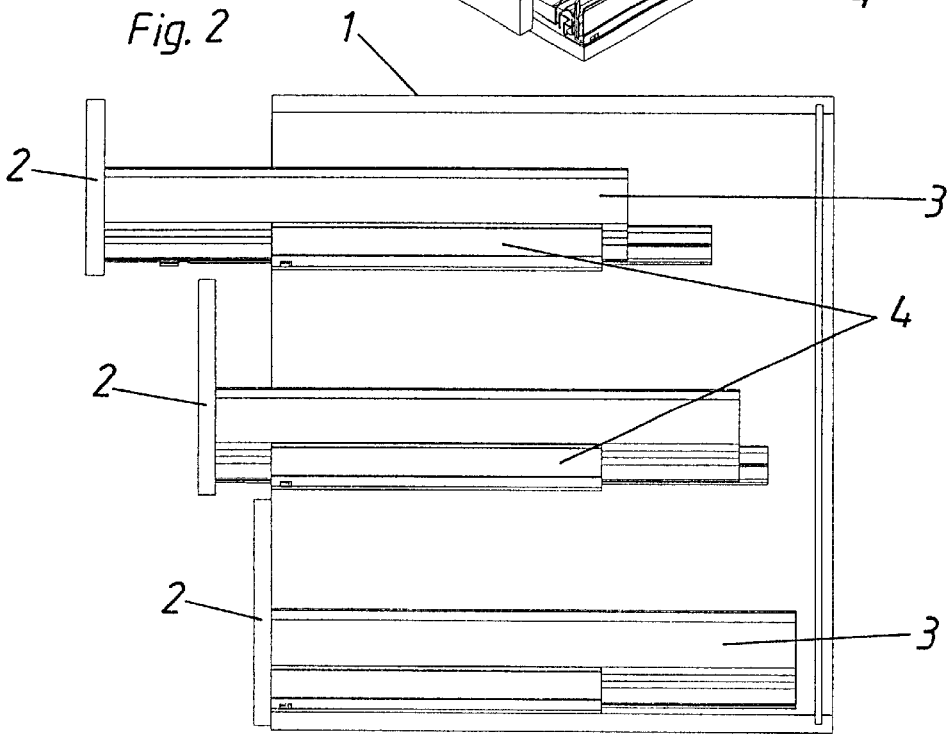
FIG. 2 is the same furniture body in side view.
Figure 3:
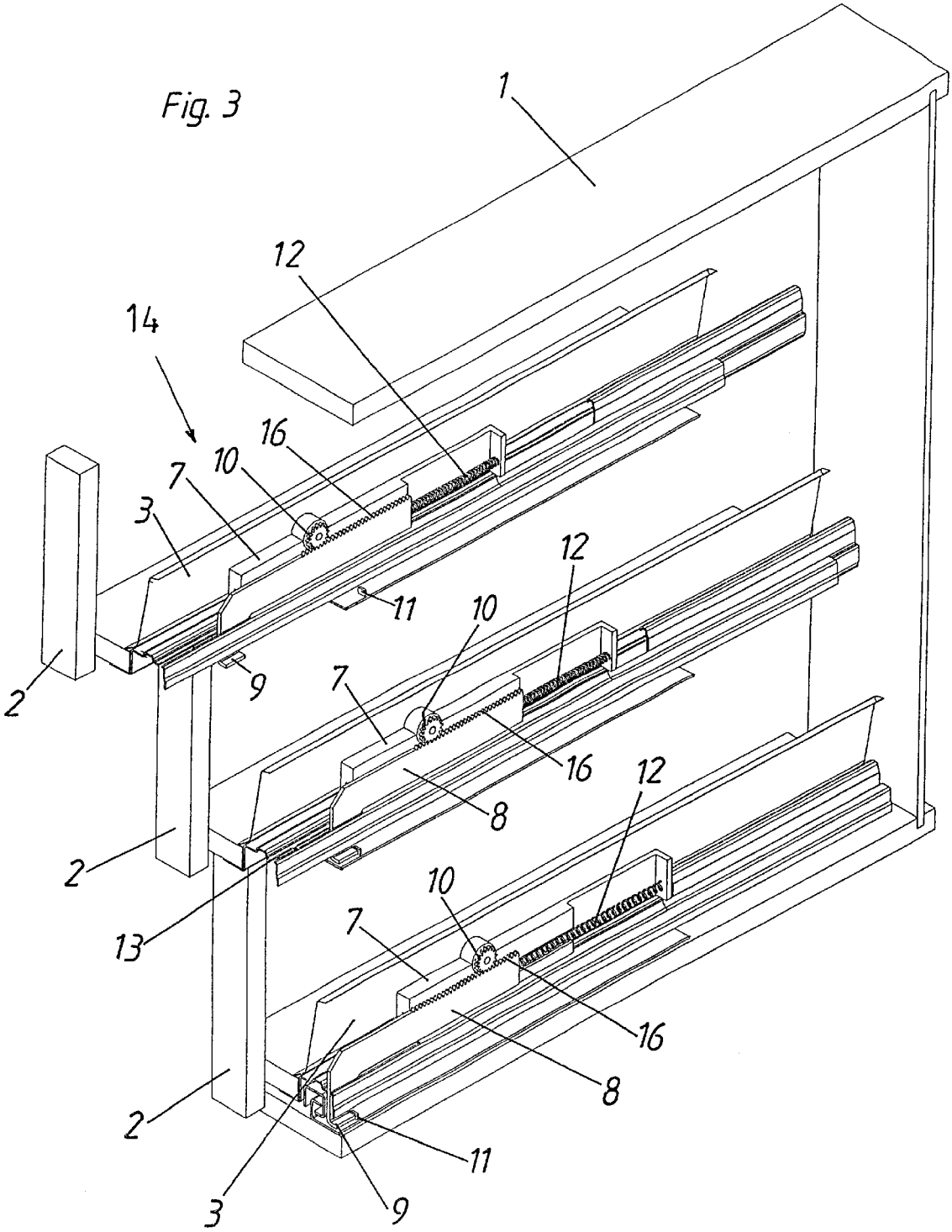
FIG. 3 is a schematic section through a furniture body and longitudinal section through drawer side walls of the drawers with one disposed above the other.
Figure 4:
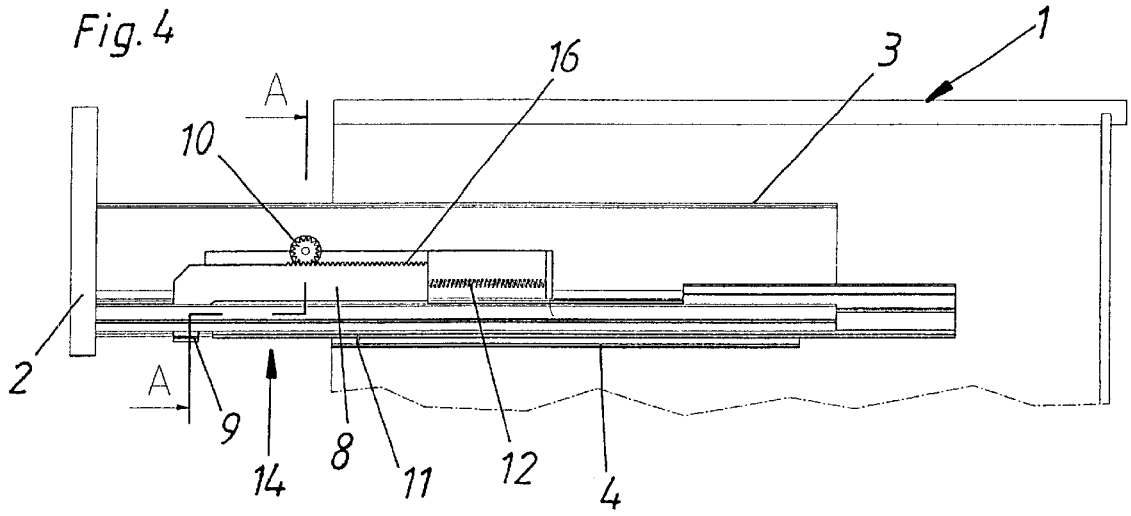
FIG. 4 is a longitudinal section through a drawer side wall.
Figure 5:
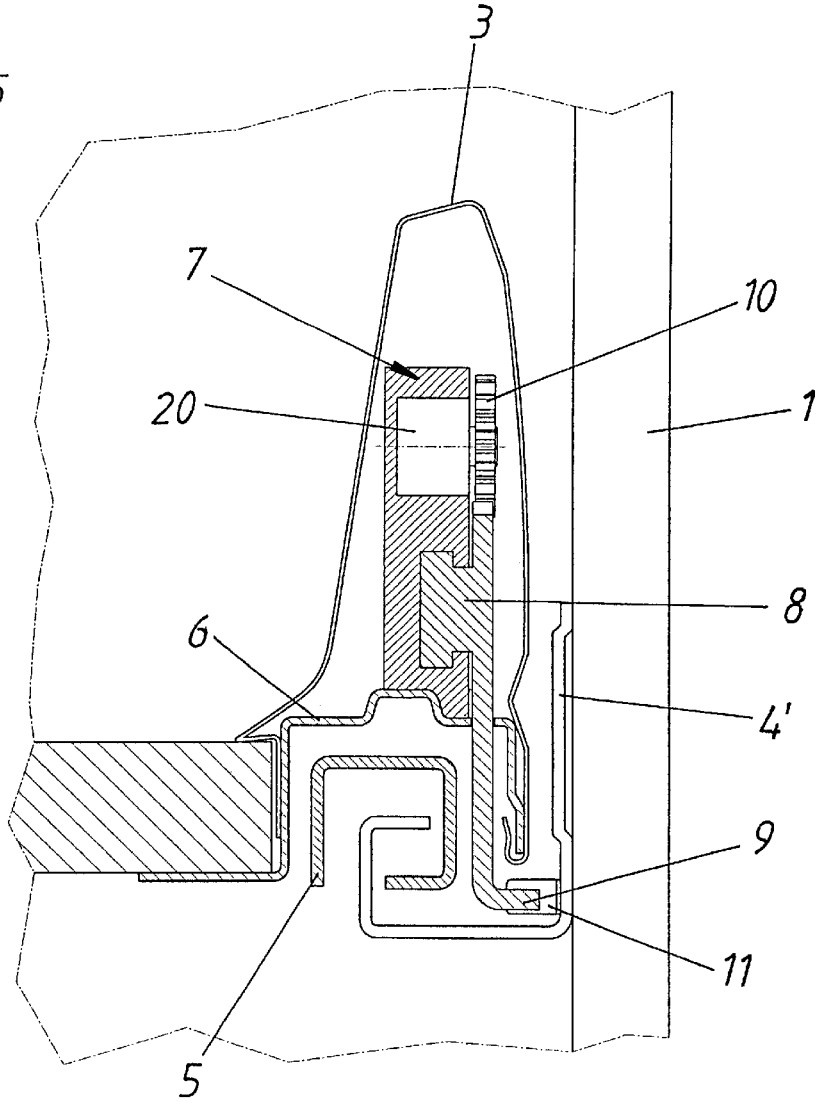
FIG. 5 is a section along line AA of FIG. 4.
Figure 6:
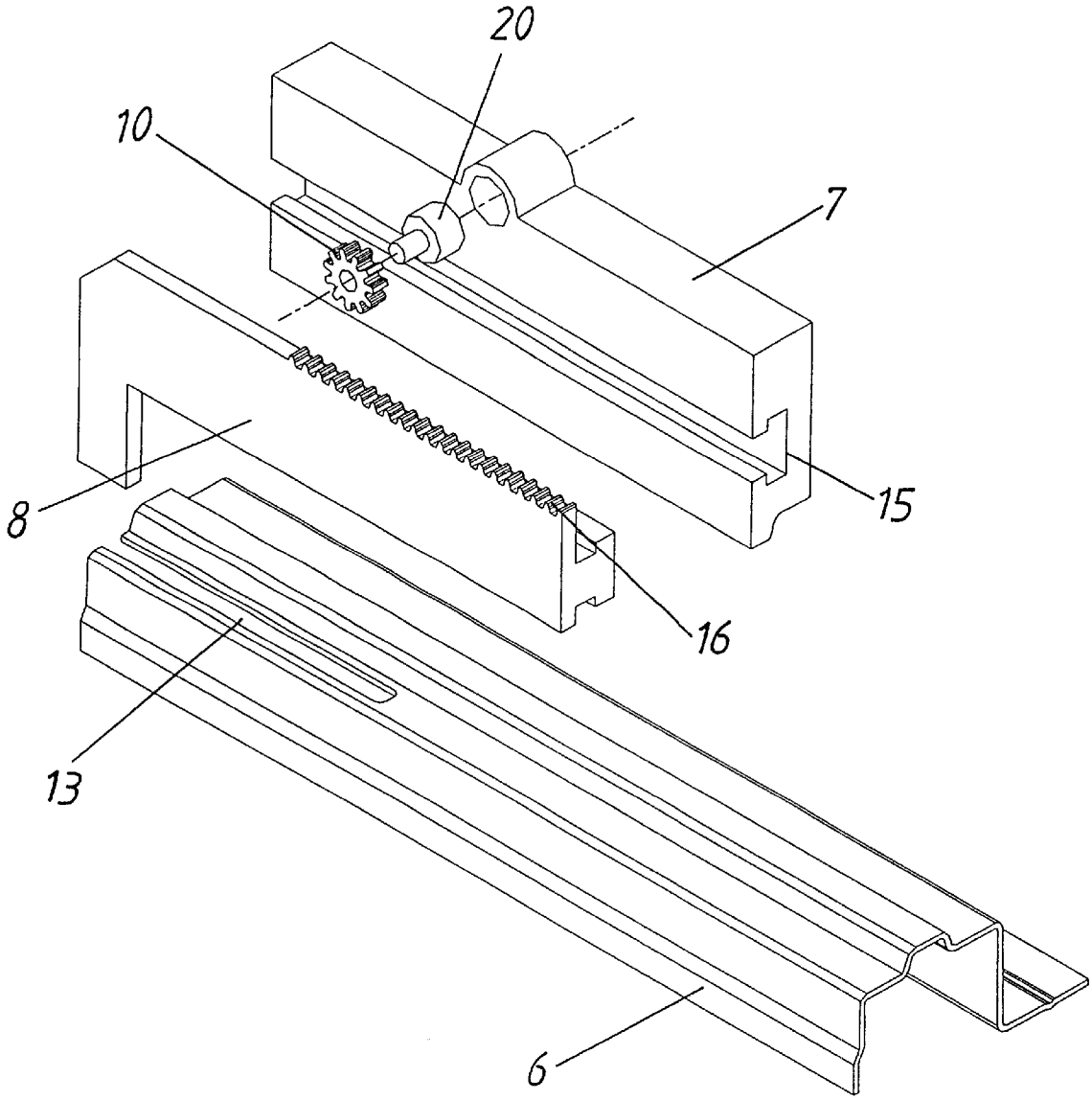
FIG. 6 is an exploded view of parts of a damper and a pull-out rail.

In a furniture body 1, drawers 2 are displaceably guided by means of a pull-out guidance assembly according to the invention.

The drawers each comprise one drawer side wall 3 on both sides thereof, each of which covers rails 4, 5, 6 of the pull-out guidance assembly except for fastening flange 4' of bearing rails 4. Also covered by the drawer side wall is the damping device 14 according to the invention.

On a pull-out rail 6 is fixed a housing 7 in which is disposed a commercially available rotation damper 20, preferably with free-wheeling. On the axle of the rotation damper 20 is supported a pinion 10.

The housing 7 is provided with an undercut groove 15, in which is supported a sliding carrier, or slider, 8 so as to be horizontally displaceable. The slider 8 is provided with a toothed rack section 16 which meshes with the pinion 10. A tension spring 12 is fastened, on the one hand, on slider 8 and, on the other hand, on housing 7.

A slider 8 comprises, furthermore, a slider stop 9 which projects through a slot 13 in the pull-out rail 6. On the bearing rail 4 or on its fastening flange 4' is developed a body-side stop 11 for the slider 8.

When a drawer 2 is opened, the tension spring 12 pulls the slider 8 into a damping position. When the drawer 2 is closed, the slider stop 9 abuts the body-side stop 11, whereupon no further relative movement occurs between the slider 8 and the bearing rail 4. However, the pull-out rail 6 is moved further toward the back together with the housing 7, whereby the pinion 10, which rolls on the toothed rack section 16, is rotated. The rotation damper 20, disposed in housing 7, thereby becomes active.

The pull-out guidance assembly according to the invention can also be provided with a drawer draw-in device, such as is described for example in EP 0 391 221 B1. The spring of the draw-in device must always be stronger than the tension spring 12 in order for the drawer 2 to be reliably closed.

When the drawer 2 is opened, the slider 8 is brought again by the tension spring 12 into the starting position, i.e. into the damping position.

In the embodiment a full extension is shown with center rails 5 disposed between the pull-out rails 6 and the bearing rails 4. The damping according to the invention, however, can also be applied with a simplex extension.

What is claimed is:

1. A pull-out guide assembly for drawers comprising:

a drawer having opposite sides each with a drawer side wall, one drawer-side pull-out rail and one body-side bearing rail;

a fluidic rotation damper mounted on either said drawer side wall or said pull-out rail, said fluidic rotation damper having a pinion connected thereto;

a slider having a toothed rack section with which said pinion meshes, said slider being movably mounted with respect to said pull-out rail, said drawer side wall and said bearing rail; and a body-side stop engageable by said slider for stopping said slider.

2. The pull-out guide assembly for drawers of claim 1, wherein a center rail is displaceably provided between said bearing rail and said pull-out rail.

3. The pull-out guide assembly for drawers of claim 1, wherein said pull-out rail is set into said drawer side wall and fixed therein.

4. The pull-out guide assembly for drawers of claim 1, wherein said body-side stop for stopping said slider is disposed on said bearing rail.

5. The pull-out guide assembly for drawers of claim 1, wherein said pull-out rail and said rotation damper are disposed within said drawer side wall.

6. The pull-out guide assembly for drawers of claim 1, wherein said rotation damper and said slider are supported in a housing fastened on said pull-out rail.

7. The pull-out guide assembly for drawers of claim 1, wherein said rotation damper and said slider are supported in a housing fastened on said drawer side wall.

8. The pull-out guide assembly for drawers of claim 1, wherein said slider has a spring biasing said slider in a direction along said pull-out rail.

9. The pull-out guide assembly for drawers of claim 8, wherein said spring is a tension spring coupled between said slider and a housing supporting said slider.

10. A pull-out guide assembly for drawers comprising:

one drawer side wall, one drawer-side pull-out rail and one body-side bearing rail provided for each of opposite sides of a drawer, wherein said drawer side wall and said drawer-side pull out rail are adapted to be fixed with respect to the drawer, and said body-side bearing rail is adapted to be fixed with respect to a body of a piece of furniture housing the drawer;

a fluidic rotation damper mounted on either said drawer side wall or said pull-out rail, said fluidic rotation damper having a pinion connected thereto;

a slider having a toothed rack section with which said pinion meshes, said slider being movably mounted with respect to said pull-out rail, said drawer side wall and said bearing rail; and a body-side stop for stopping said slider.

11. The assembly of claim 10, wherein said slider is movably mounted in a housing that is fixed with respect to said drawer side wall.

12. The assembly of claim 11, wherein said slider has a spring connected between said slider and said housing biasing said slider in one direction of movement of the drawer.

13. The assembly of claim 10, wherein said body-side stop is mounted on said bearing rail.

* * * * *